US005667004A

United States Patent [19]

Kroetsch

[11] Patent Number: 5,667,004

[45] Date of Patent: Sep. 16, 1997

[54] MOLDED PLASTIC HEAT EXCHANGER MOUNTING CHANNEL

[75] Inventor: Karl Paul Kroetsch, Williamsville, N.Y.

[73] Assignee: General Motors Corporation, Detroit, Mich.

[21] Appl. No.: 639,885

[22] Filed: Apr. 29, 1996

[51] Int. Cl.[6] ..... F28F 9/00; F28F 1/32

[52] U.S. Cl. ..... 165/41; 165/67; 165/149; 165/906; 165/905; 180/68.4

[58] Field of Search ..... 165/149, 67, 41, 165/906, 905; 180/68.4

[56] References Cited

U.S. PATENT DOCUMENTS 3,447,598 6/1969 Kaess, Jr. ..... 165/67

4,484,621 11/1984 Kuchelmeister ..... 165/149

FOREIGN PATENT DOCUMENTS 2435736 3/1975 Germany ..... 165/149

0164996 9/1983 Japan ..... 165/149

0169497 7/1988 Japan ..... 165/153

*Primary Examiner*—John K. Ford

*Attorney, Agent, or Firm*—Patrick M. Griffin

[57] ABSTRACT

A side mounting channel for a radiator is an integrally molded plastic unit with a shape particularly tailored to efficiently resisting the warping forces that result from thermal growth of the radiator core. Each side channel has a flat web and parallel, perpendicular edge flanges that substantially symmetric to the web. The edge flanges taper down into the plane of the web over a transition portion of defined length.

1 Claim, 3 Drawing Sheets

32
T
38
22
36
30
38
3
4
T
3
4
34

28
24
29
14
W
26
28
29

22
14
36
38
40
30
38
36

36
22
30
36

MOLDED PLASTIC HEAT EXCHANGER MOUNTING CHANNEL

This invention relates to automotive heat exchangers in general, and specifically to an improved mounting channel therefor that is integrally molded of plastic with a particular shape and configuration.

BACKGROUND OF THE INVENTION

Automotive heat exchangers, such as radiators, have historically been the parallel flow type, with a core consisting of plurality of flat, evenly spaced metal flow tubes running end to end from an inlet manifold tank to an outlet manifold tank. Corrugated cooling fins brazed crest to crest between the tubes dissipate heat from the engine coolant through the tube walls and to a forced air stream blown over the core. The ends of the tubes are brazed fluid tight through matching slots in a pair of parallel metal header plates, and the entire core is typically an aluminum alloy in current production. Increasingly, the manifold tanks consist of a molded plastic shell crimped to the header plates, and the tanks comprise two sides of a basically four sided shape. On the other two sides of the core, a pair of outermost tubes may be left unused or "dead", or a pair of simple metal stampings may border and protect the outermost tubes, brazed at their ends to the ends of the header plates. The radiator may be mounted to the vehicle with the inlet tank at the top (and outlet tank on the bottom), a so called down flow configuration, or with both tanks on the sides. Especially in the down flow configuration, it has been found useful to build a four sided frame around the core, in effect, with a pair of side channels that border the sides of the core, and the ends of which are fixed to the ends of the two tanks. The side channels can then be fixed to the vehicle body to mount the entire radiator. Typically, the side channels are stamped steel members.

Because of expansion with heating, the core, when confined within a substantially fixed four side frame, is subject to warping forces that can tend to bend it out its normal flat shape. Regardless of whether the core actually warps, its tendency to do so can strain the core tubes, especially near the four corners. Some of this tendency can be reduced by allowing one end of each channel to "float" or slide to an extent, by fixing it to the end of the tank through an elongated slot. This does not remove all the warping force, however, and the relatively rigid steel side channel is not as inherently able to resist those forces as efficiently a more resilient material, such as plastic, would be. However, existing steel side channel designs are not optimally designed to be simply replicated in plastic, in the way that a molded plastic shell can directly replace the stamped metal shell of a manifold tank or "water box" in a radiator.

SUMMARY OF THE INVENTION

The invention provides an integrally molded plastic side mounting channel for a radiator that has a shape optimized to take advantage of the molded plastic material. In the embodiment disclosed, each of the two side channels has a flat, generally rectangular web with an end to end length that matches the tank spacing, and an edge to edge width comparable to the core thickness. The two ends are joined to the ends of the radiator tanks as a conventional steel channel would be. Integrally molded to the edges of the web are a parallel pair of edge flanges, which are substantially symmetrical to the web. The flange to flange spacing is slightly greater than the width of the core. Lengthwise, however, the side flanges terminate substantially short of the ends of the web. Instead, each has a transition portion that tapers steadily down toward the nearest end of the channel and generally into the plane of the web. When the ends of the channels are fixed to the ends of the tanks, to complete the four sided frame around the aluminum core, the inboard edge flanges can actually overlap the sides of the core that they border, since they have a separation greater than the core width.

In operation, when the core is subject to warping forces, the side channels can flex more easily, since it is more resilient than steel, and less strain is consequently put on the core. More importantly, the symmetrical relationship of its edge flanges and web allow it to react more efficiently to warping forces in any direction. The extra width of the molded plastic side channels created by the edge flanges does not create a packaging constraint, since the inboard portion thereof can actually overlap slightly with the sides of the core, and the flanges themselves are relatively thin. In practice, substantially less strain on certain portions of the core has been measured, along with far greater channel durability. The inherent lighter weight and corrosion resistance of plastic is also an advantage.

DESCRIPTION OF THE PREFERRED EMBODIMENT

These and other features of the invention will appear from the following written description, and from the drawings, in which.

Figure 1:
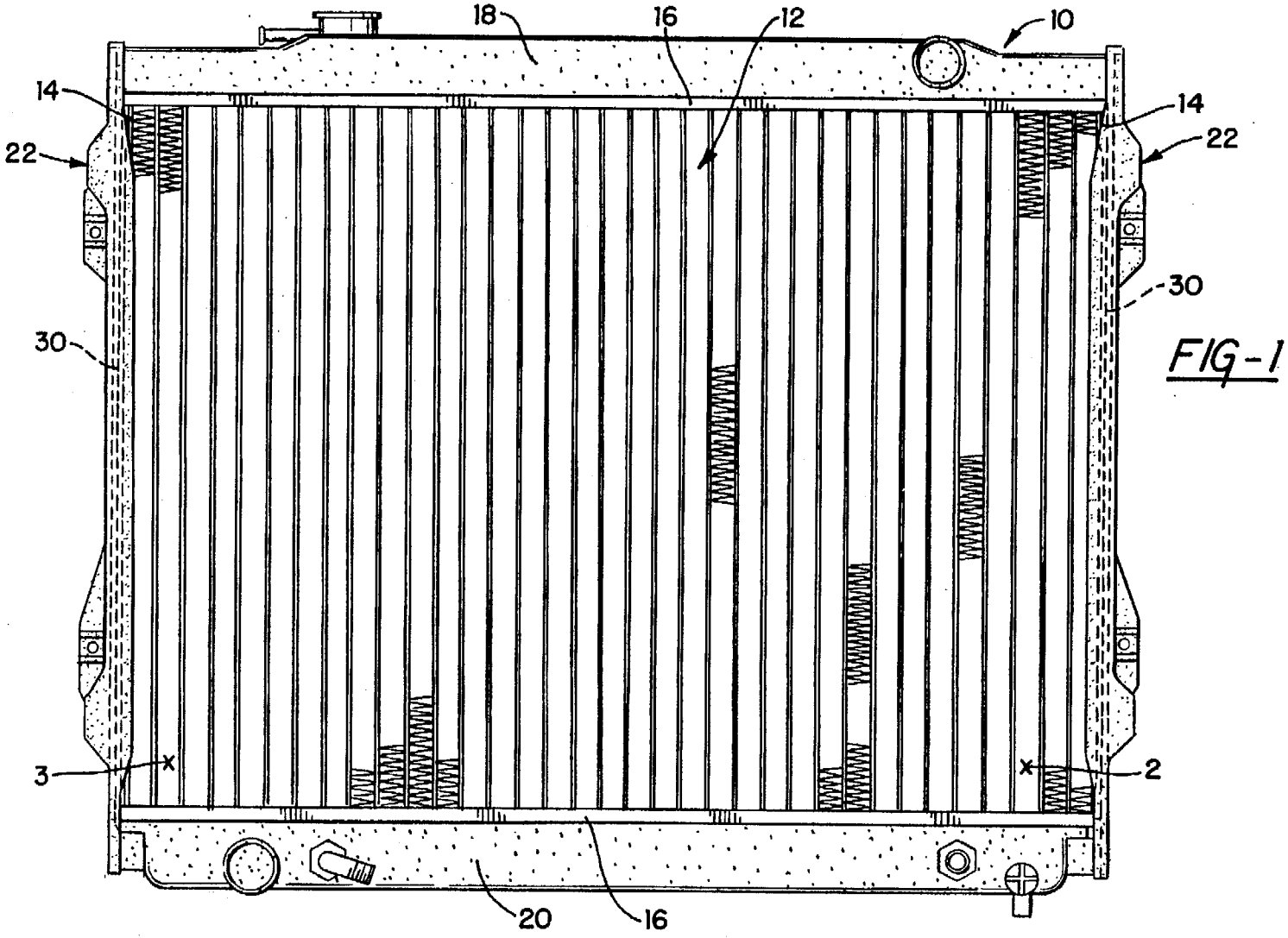
FIG. 1 is a front view of a radiator incorporating the plastic side channels of the invention.

Referring first to FIG. 1, a four sided heat exchanger, in this case a vehicle radiator, is indicated generally at 10. The bulk of radiator 10, in terms of both weight and area, is taken up by a metal core 12, which is itself generally four sided and flat, with a predetermined thickness. Core 12 consists of an evenly spaced array of flat walled, aluminum flow tubes, the width of which define the thickness of core 12. Only the outermost side tubes of core 12 are specifically indicated, at 14. These may be actual tubes, which are plugged or otherwise left inactive, or they may be separate reinforcing members of comparable length and width, designed to armor and shield the sides of core 12. In either event, the side tubes 14 define two of the four sides of core 12. The other two sides of core 12 are provided by slotted aluminum header plates 16, each of which is crimped to either an upper, inlet tank shell 18, or a lower, outlet tank shell 20, which are molded, one piece plastic units. The header plates 16 and tank shells 18 and 20 together provide a pair of complete manifold tanks that both feed and drain the core 12. The pair of complete manifold tanks, in turn, represent two of four sides of the rectangular radiator 10, the other two sides of which are provided by a pair of side channels made according to the invention, indicated generally at 22. In a vehicle, the bottom tank shell 20 would typically rest on a lower body rail, insulated by a pair of elastomer pads, and the upper shell 18 would sit below a parallel, upper rail. When radiator 10 is installed, the side channels 22 are solidly attached by screws or bolts to a pair of parallel, vertically oriented body members, which are themselves quite rigid.

Figures 2, 3, 4, 5:
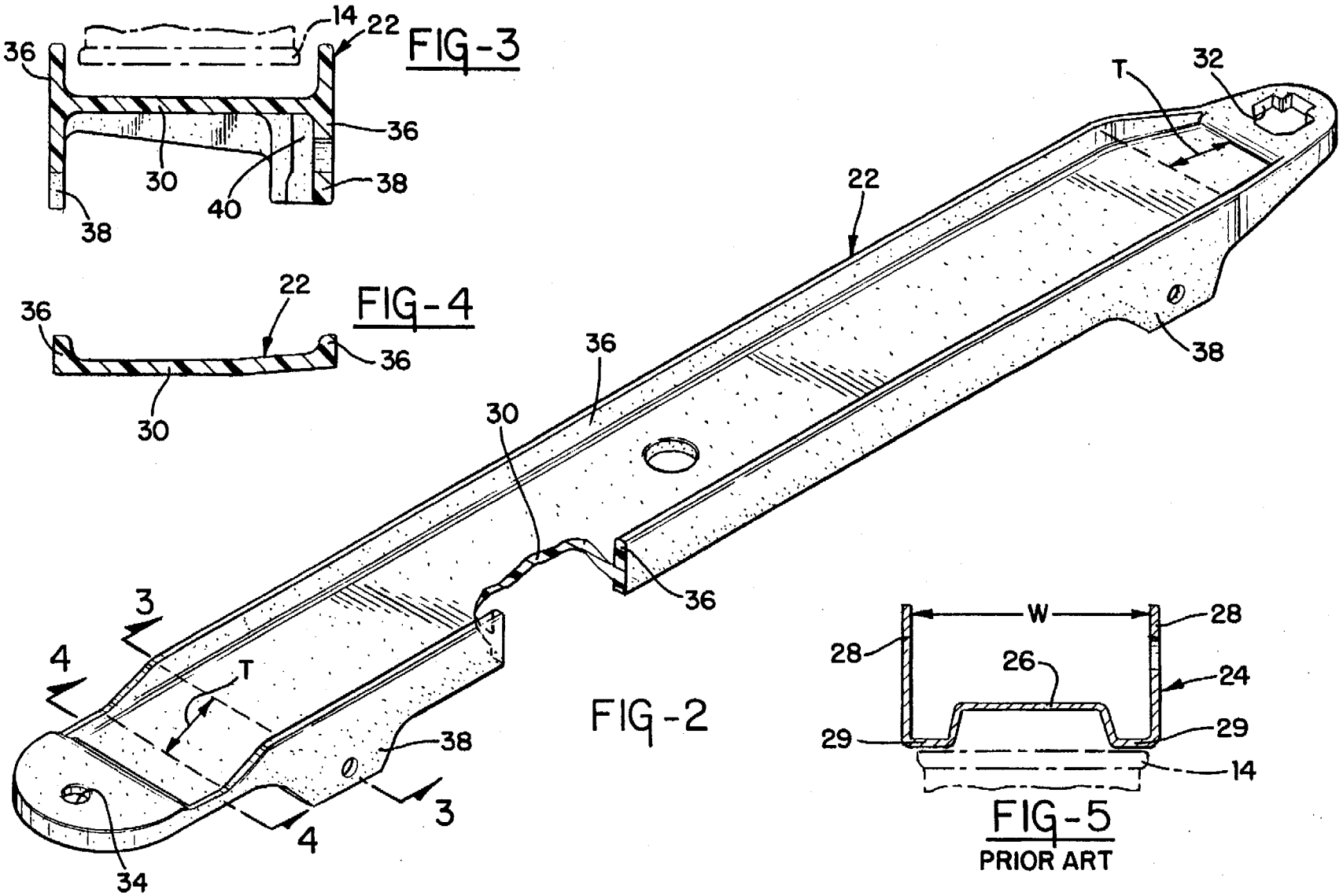
FIG-5 PRIOR ART
FIG. 2 is a perspective view of a preferred embodiment of the side channel alone.
FIG. 3 is a cross section taken in the plane represented by the line 3—3 of FIG. 2.
FIG. 4 is a cross section taken in the plane represented by the line 4—4 of FIG. 2.
FIG. 5 is a typical cross section of a conventional steel side channel.

Referring next to FIGS. 1 and 5, a prior art, stamped steel side channel is indicated generally at 24. The steel side channels 24 would be attached to the same vertically oriented body members, in the same way. In operation, a heated metal object such as core 12 is subject to expansion in all directions. Unless the frame that surrounds and contains it can completely accommodate that expansion, the expanding core 12, confined as it is, is subjected to forces that can tend to warp it out of its normal, flat configuration. Now, it is unlikely that the expansion of core 12 would be enough to in fact actually warp core 12 out of plane, but the forces are reflected in strain that can be gauged and measured. For example, two locations noted near the bottom corners of core 12 at which testing measurements were taken for both the old and new channel design are marked "2" and "3". Results of such testing are described further below. First, certain structural features and limitations of the conventional steel channel 24 may be noted. Steel channel 24 is a unitary stamping having a generally "W" shaped cross section, with a flat central wall 26, upturned side flanges 28, and a pair of concave ribs 29 (concave as viewed from outside of channel 24). The ribs 29 are intended to add stiffness, in the manner or corrugations. The nature of the stamping process is such that the ribs 29 cannot be made very narrow, nor stamped very deeply, without a proportional increase in their width. Otherwise, the steel stock would be subject to cracking. As a consequence, the total width of the channel 24, indicated at W, must be at least equal to the width of the wall 26 plus the required width of both of the ribs 29. As disclosed, the wall 26 is not wide enough to allow the core side tube 14, shown in dotted lines to be tucked in between the ribs 29. If it were, then the total width (and weight) of channel 24 would be that much greater, perhaps larger than possible within the room available in a particular vehicle. Also, as disclosed, the flanges 28 are not symmetrical to the central wall 26, that is, they have more height located outboard of the plane of wall 26 than inboard of it. The flanges 28 also typically extend, at that height, all the way along the length of channel 24, end to end. If, in addition to making wall 26 wide enough to accommodate the side tube 14 directly between the ribs 29, it was also desired to stamp the ribs 29 deeply enough to make the flanges 28 symmetrical to the wall 26, then the width of the ribs 29, and total width of channel 24, would have to be made that much greater. Consequently, the configuration shown, with relatively narrow wall 26 and asymmetrical flanges 28, is typical. This is not the most optimal shape and cross section, either for structural efficiency or packaging compactness. In addition, steel is inherently stiff and unyielding, which is not necessarily an advantage in accommodating a thermally expanding structure such as core 12. It would be possible, of course, simply to replicate the steel channel 24 identically in molded plastic, with it's inherent greater flexibility. However, to do so would be to carry over the structural compromises and short comings of the steel channel 24, as well.

Referring next to FIGS. 1 through 4, the plastic channel 22 of the invention provides a shape and structure optimized to the task at hand of both mounting core 12 in a compact package and accommodating its thermal growth. Channel 22 is an integrally molded plastic unit, molded from nylon or other suitable moldable material. The majority of channel 22's length and width is comprised of a flat, central web 30. Each channel 22 will ultimately comprise one side of the four sided frame around core 12, and so web 30 has an end to end length comparable to the core 12. Specifically, the ends of channel 22 extend past the ends of web 30 and are thickened and strengthened so that one end can have a key hole shaped slot 32 that is slidably joined to an end of the upper tank shell 18, while the other end has a simple round hole 34 that allows it to be rigidly bolted to an end of the lower tank shell 20. The width of web 30 is substantially equal to (or slightly greater than) the thickness of core 12, as best seen in FIG. 3. Integrally molded along the edges of web 30 are a pair of perpendicular, parallel edge flanges 36. The edge flanges 36 extend to both sides of web 30, that is, to the inboard side shown in FIG. 2, and to the opposite, outboard side as well. This is possible because, as best seen in FIG. 3, the core side tube 14 can fit between the edge flanges 36. There is not a significant consequent increase in the overall width of channel 22, since the edge flanges 36 may be molded relatively thin, as thin as web 30. Moreover, while the edge flanges 36 are substantially symmetrical to the web 30 as disclosed, they need not be exactly bisected thereby. Instead, the width of the edge flanges 36 to either side of the web 30 may be varied and tailored to meet the needs of any particular design. This design flexibility flows from the fact that the width of the core 12 can fit between the edge flanges 36 easily, without a significant increase in the overall width of the channel 22 (unlike the steel channel 24). Therefore, it is possible for the inboard side of the edge flanges 36 to overlap with the core 12 to whatever extent is desired. In the embodiment disclosed, as best seen in FIG. 2, the edge flanges 36 in fact extend more to the inboard side of the web 30, except at localized areas where attachment ears 38 are integrally molded with the edge flanges 36. There are four such ears 38, which are at staggered locations so as to allow easy bolting to the vehicle body when radiator 10 is installed. Unlike the ease with the steel channel side flanges 28, the molded plastic edge flanges 36 do not hold their basic height all the way to the end. Instead, both the inboard and outboard sides thereof taper gradually down toward the ends of channel 22, merging completely (or almost completely) into the thickness of web 30, as best seen in FIG. 4 at a point short of the ends of channel 22 and clear of the slot 32 and hole 34. This tapering occurs across a transition portion indicated at T in FIG. 2, the length of which comprises approximately 0.085 to 0.17 of the total end to end length of channel 22. This tapering keeps the edge flanges 36 out of the way of the fasteners used in the slot 32 and hole 34, and also prevents the stress risers that are incident to sharp corners and rapid transitions in height or thickness. The formation of such a transition portion T is well suited to the process by which plastic channel 22 is molded, and is another indication that channel 22 is more than a simple replication of the steel channel 24 in a different material. Finally, rib reinforced pockets 40 are molded behind the ears 38 to accommodate the bolts or other fasteners that would ultimately be used to mount the channels 22 and radiator 10.

Figure 6:
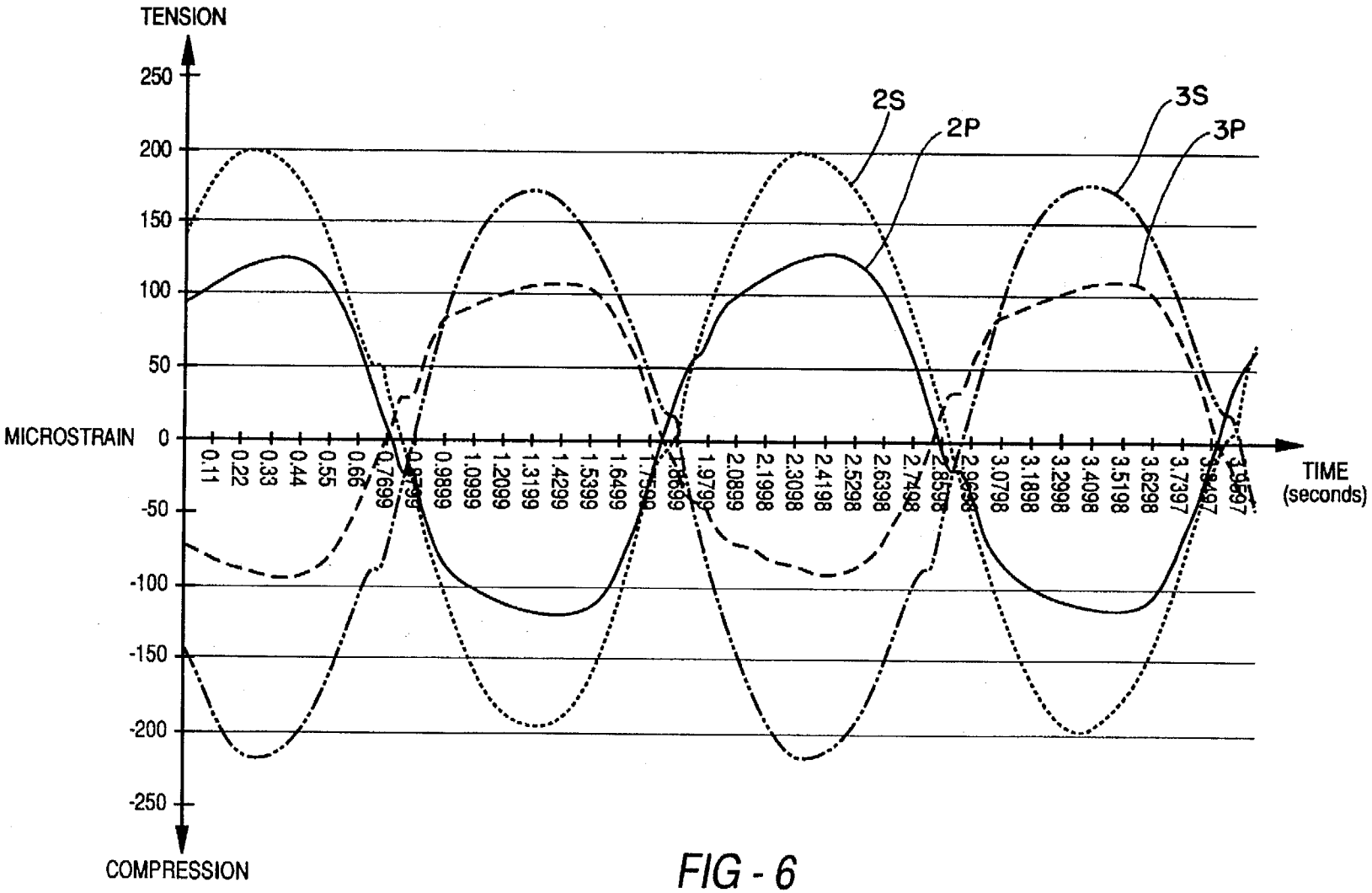
FIG. 6 is a graphical representation of test results comparing the performance of a conventional steel side channel to that of the invention.

Referring next to FIG. 1 and 6, testing results show a significant improvement in the operation of plastic channel 22, with its particular shape, over conventional steel channel 24. Strain gauges at the locations 2 and 3 were used to monitor stress in a radiator 10 built with either a pair of each channel 22 or 24, which are indicated as 2P, 3S, etc. in FIG. 6, so as to distinguish location and material. In the test, a channel on one side was held steady while the other was twisted back and forth about its center, out of the plane of the of the core 12, to simulate the kind of warping forces described above. As such, the strain at each location would vary periodically from tension to compression, as show in the graph. Strain was measured in the dimensionless units of microstrain, as will be familiar to those skilled in the art. It was found that the total strain at location 2, with the plastic channel 22, was some 38% lower compared to the steel channel 24, and some 48% lower and location 3. This is a significant difference, and is thought to be due in part to the significantly greater resilience of the plastic channel 22, which has more "give" in response to the expanding core 12, as well as the fact that its shape, with the web 30 more nearly at the center of the edge flanges 36, is more structurally efficient per se. The data shown in FIG. 6 is also represented in summary form in the table below:

| Loading Description | Plastic Channel | | Steel Channel | |
|---|---|---|---|---|
| Gauge Location | 2P | 3P | 2S | 3S |
| Minimum (compression) | −121.6 | −95.2 | −197.3 | −219.2 |
| Maximum (tension) | 126.0 | 106.4 | 201.2 | 170.9 |
| Total range (peak to peak) | 247.6 | 201.6 | 398.5 | 390.1 |

Variations in the disclosed embodiment could be made. As noted, the edge flanges 36 could be made even more symmetric to the web 30, even essentially bisected thereby. There is no limitation on the width of or extent of the side flanges 36, as with the steel channel 24. Therefore, it is not intended to limit the invention to just the embodiment disclosed.

I claim:

1. In a vehicle having a generally four sided heat exchanger with a core having a predetermined thickness and a substantially planar configuration that is subject to warping forces in use, a channel for mounting one side of said core to said vehicle, comprising, a generally flat, substantially rectangular, molded plastic central web having an inboard side and an outboard side and an end to end length and edge to edge width comparable to said core, with each end adapted to be fixed to said heat exchanger one side, a pair of edge flanges molded integral with and substantially perpendicular to said web, said flanges being substantially symmetrical to both sides of said web and extending for less than the entire end to end length of said web, each edge flange further having a transition portion tapering down toward an end of said web and into said web in which the length of said transition portion is approximately 0.085 to 0.17 of the end to end length of said channel, whereby said warping forces are efficiently resisted.

* * * * *